US008771001B2

(12) United States Patent
Li et al.

(10) Patent No.: US 8,771,001 B2
(45) Date of Patent: Jul. 8, 2014

(54) CARD EDGE CONNECTOR

(75) Inventors: Zhuang-Xing Li, Kunshan (CN); Xin-Wei Wang, Kunshan (CN); Xue-Wu Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 122 days.

(21) Appl. No.: 13/568,134

(22) Filed: Aug. 7, 2012

(65) Prior Publication Data

US 2013/0040476 A1 Feb. 14, 2013

(30) Foreign Application Priority Data

Aug. 11, 2011 (CN) ..... 2011 2 0289467

(51) Int. Cl.
*H01R 13/639* (2006.01)

(52) U.S. Cl.
USPC ..... 439/328; 439/160

(58) Field of Classification Search
USPC ..... 439/327, 160, 328

IPC ..... H01R 12/721,13/639, 23/7005, 23/7068; H05K 7/1405

See application file for complete search history.

(56) References Cited

U.S. PATENT DOCUMENTS

| | | | | |
|---|---|---|---|---|
| 4,198,024 | A * | 4/1980 | Cavanna | 248/544 |
| 6,183,284 | B1 * | 2/2001 | Gill et al. | 439/327 |
| 6,769,927 | B2 * | 8/2004 | Brewer | 439/328 |
| 7,484,978 | B1 | 2/2009 | Gao | |
| 7,641,495 | B1 * | 1/2010 | Sun | 439/327 |

* cited by examiner

*Primary Examiner* — Hien Vu

(74) *Attorney, Agent, or Firm* — Wei Te Chung; Ming Chieh Chang

(57) ABSTRACT

A card edge connector (100) includes an elongated housing (1) and a plurality of contacts (2). The housing (1) has two side walls (103) and a central slot (109) between the two side walls (103) for receiving a memory module (9). The card edge connector (100) includes a latching mechanism (5) mounted on the two side walls (103) for resisting the memory module (9) downwardly. The latching mechanism (5) can prevent the memory module (9) from moving upwardly, thereby the memory module (9) could be stably connected with the card edge connector (100).

8 Claims, 5 Drawing Sheets

CARD EDGE CONNECTOR

BACKGROUND OF THE INVENTION

1. Field of the Invention

The present invention generally relates to a card edge connector and more particularly to a card edge connector with a latch.

2. Description of Related Art

U.S. Pat. No. 7,484,978 discloses a card edge connector including an elongated housing, a plurality of contacts retained in the housing and a pair of ejectors pivoted on two opposited ends of the housing. The housing has an elongated central slot extending along a longitudinal direction to receive a memory module. The ejectors each have an ejecting portion inwardly extending to the central slot and a locking head latching with the memory module. When the memory module is inserted into the central slot, the ejectors rotate to latch with the memory module. But the ejectors could be easily actuated by an outside force that may make the memory module fly out of the card edge connector.

Other objects, advantages and novel features of the present invention will become more apparent from the following detailed description of the present embodiment when taken in conjunction with the accompanying drawings.

SUMMARY OF THE INVENTION

The present invention provides a cable connector comprises an elongated housing, a plurality of contacts retained in the housing and a pair of latching mechanisms assembled in the side walls to press the memory module downwardly. The housing has a pair of longitudinal side walls extending along a longitudinal direction, an elongated central slot formed therebetween for receiving a memory module. The card edge connector includes a pair of the positioning block located in the left and right sides of the side walls and the latching mechanisms latch to the positioning block. The latching mechanisms are located symmetrically and closed to the ejectors. The latching mechanisms can prevent the memory module from moving upwardly, thereby the memory module could be stably connected with the card edge connector.

Other objects, advantages and novel features of the present invention will become more apparent from the following detailed description of the present embodiment when taken in conjunction with the accompanying drawings.

DETAILED DESCRIPTION OF THE INVENTION

Figure 1:
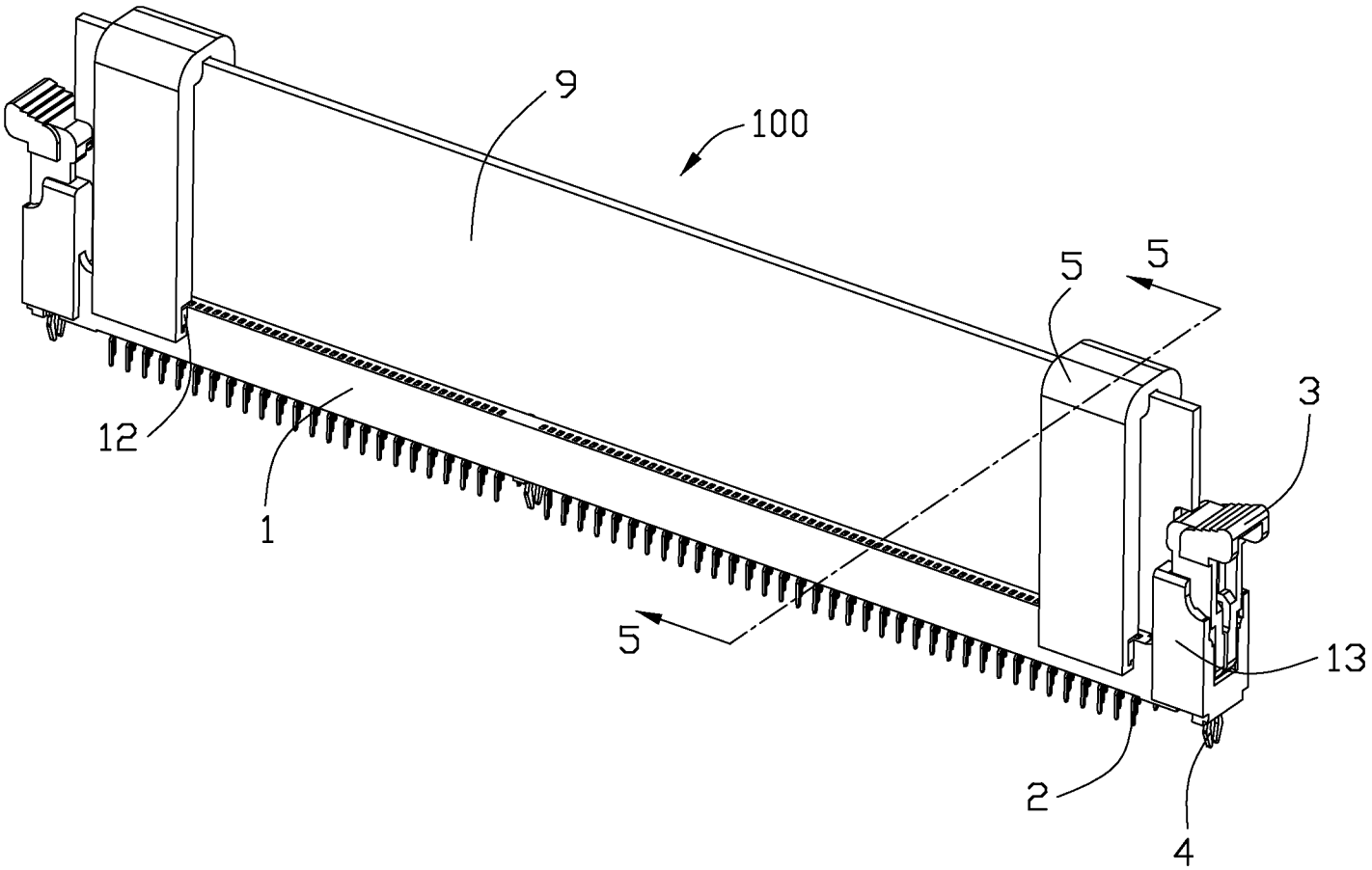
FIG. 1 is an assembled, perspective view of a card edge connector according to a preferred embodiment of the present invention.

Reference will be made to the drawing figures to describe the present invention in detail, wherein depicted elements are not necessarily shown to scale and wherein like or similar elements are designated by same or similar reference numeral through the several views and same or similar terminology.

Referring to FIG. 1, a card edge connector 100 according to the present invention is preferably a memory socket to be mounted on a mother printed circuit board, and comprises an elongated housing 1, a plurality of contacts 2 retained in the housing 1, a pair of ejectors or retention devices 3 pivoted on two opposite ends of the housing 1, a pair of board locks 4 mounted onto a bottom side of the housing 1 and a pair of latching mechanisms 5 assembled to the housing 1. The length direction of the housing 1 is defined as a longitudinal direction and a width direction of the housing 1 which is vertical to the two side walls 103 is defined as a transverse direction.

Figure 2:
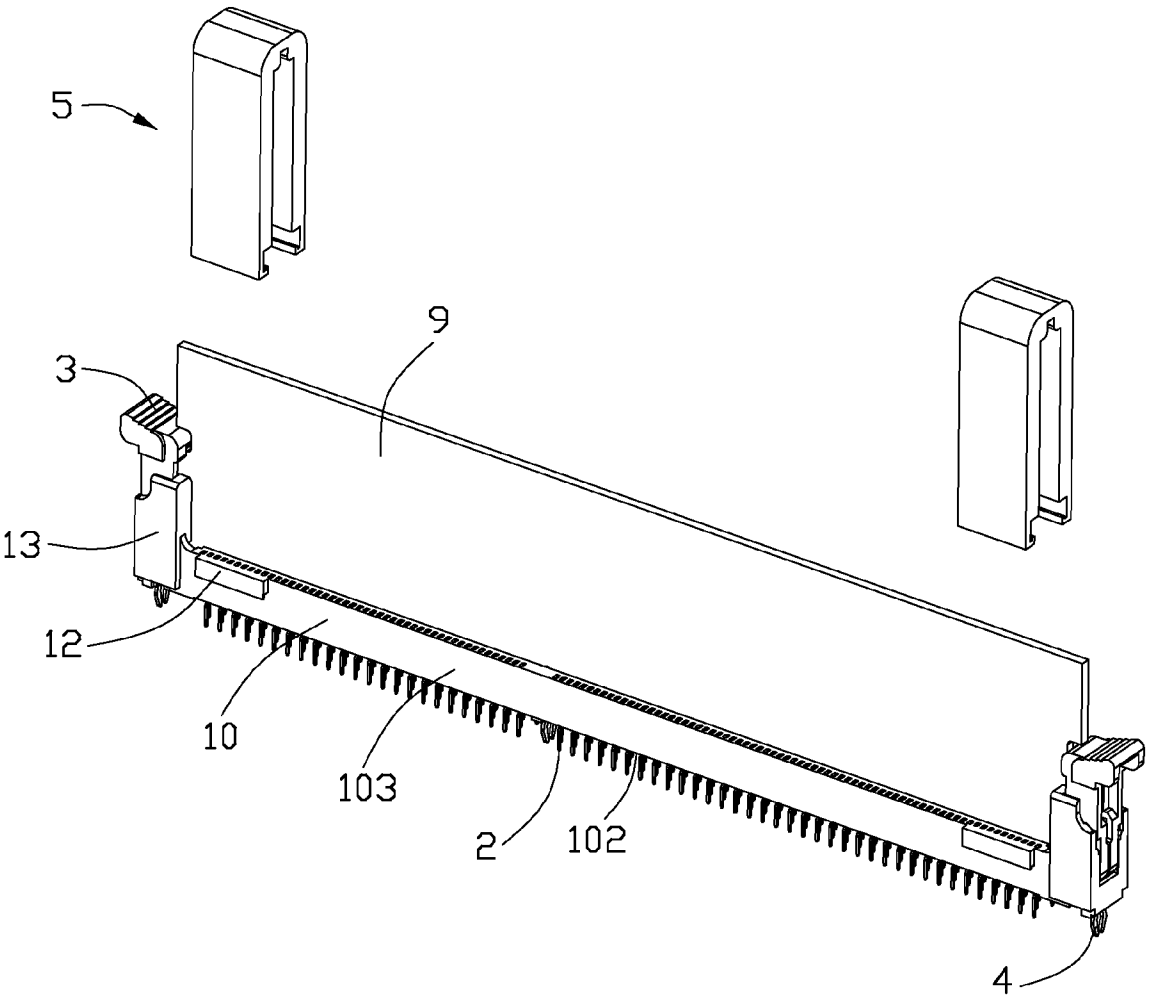
FIG. 2 is an exploded, perspective view of the card edge connector as shown in FIG. 1.
Figure 3:
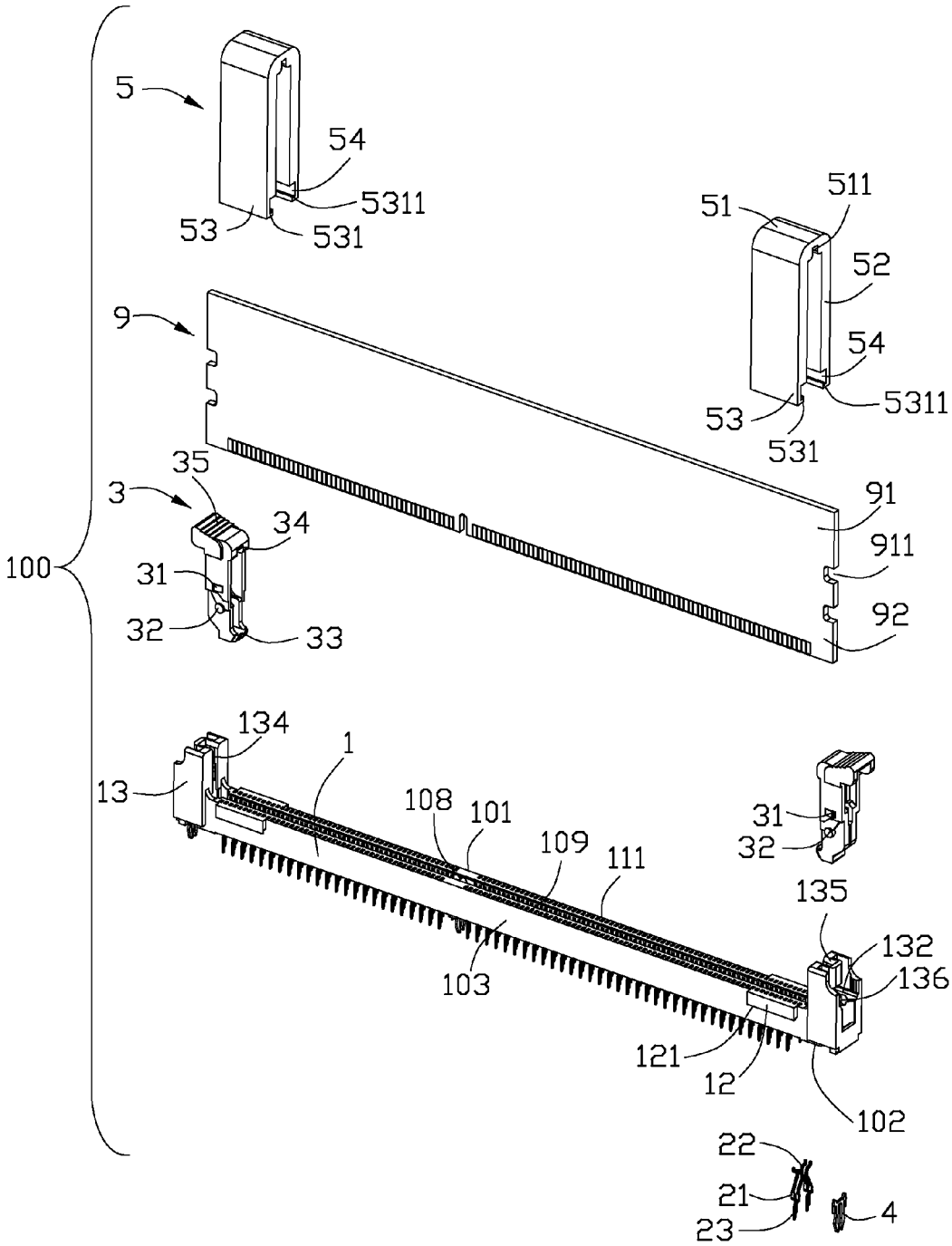
FIG. 3 is another exploded perspective view of the card edge connector as shown in FIG. 1.
Figure 4:
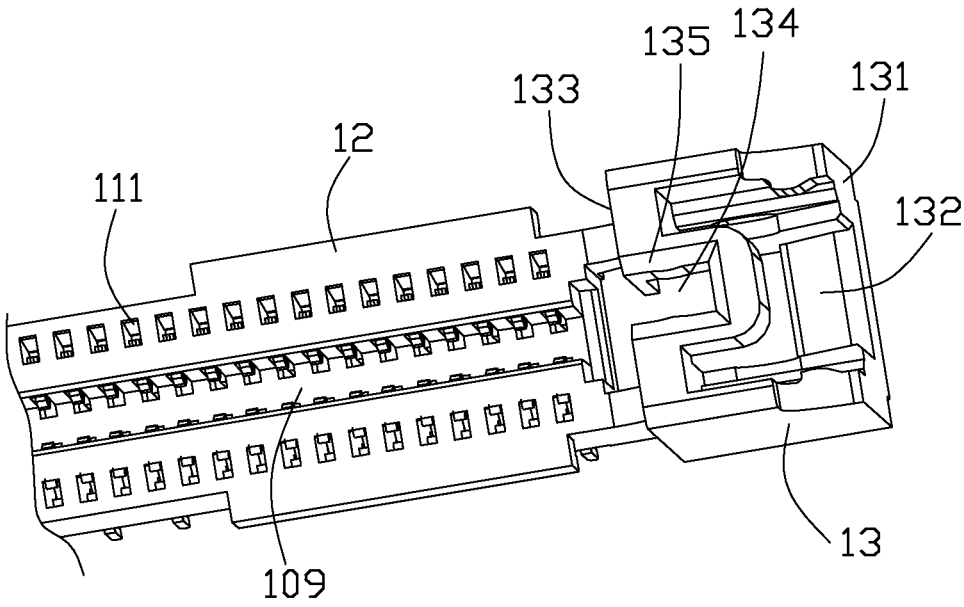
FIG. 4 is an enlarged view of a part of the electrical card connector shown in FIG. 3.

Referring to FIGS. 2-4, the housing 1 has a pair of longitudinal side walls 103 extending along the longitudinal direction thereof, an elongated central slot 109 formed between the longitudinal side walls 103 for receiving a corresponding memory module 9 therein and a key 108 formed in the central slot 109 to divide the central slot 109 into a left portion and a right portion to prevent the memory module 9 from wrongly inserting. The housing 1 has a mating face 101 from which the central slot 109 is recessed, a mounting face 102 for mounting on the mother printed circuit board and two tower portions 13 disposed on two longitudinal ends thereof for assembling the ejectors 3. The side walls 11 each have a row of terminal slots 111 communicating with the central slot 109.

Figure 5:
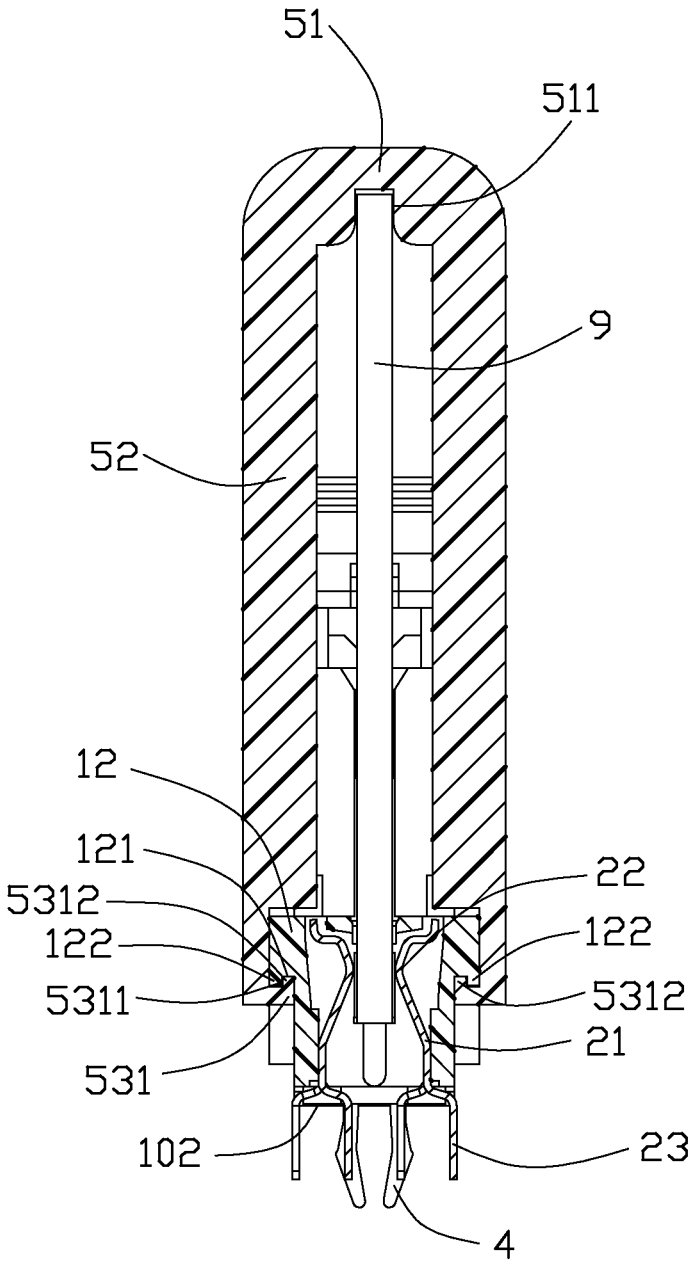
FIG. 5 is a cross-sectional view of the card edge connector taken along line 5-5 of FIG. 1.

Referring to FIG. 5, the side walls 103 each have a pair of positioning blocks 12 on an outside surface. The positioning blocks 12 are located closed to the tower portions 13 respectively, and extend along the sides walls 103. The positioning blocks 12 are disposed as a rectangular shape. The positioning blocks 12 each have a first guiding slot 121 depressing upwardly from a bottom of the positioning block 12 near the outside surface of the side wall 103 but not passing upwardly therethrough. The first guiding slot 121 passes through the positioning block 12 along the longitudinal direction but not passes outwardly thereof. A first flange 122 is formed which is adjacent to the first guiding slot 121. The first guiding slot 121 is defined between the first flange 122 and the side wall 103. A top of the positioning block 12 is coplanar with the mating face 101 and a bottom of the positioning block 12 is higher than the mounting face 102.

Referring to FIG. 3, each of the pair of tower portions 13 has a first receiving cavity 131 adjacent to the central slot 109 for receiving a side edge 91 of the memory module 9, a second receiving cavity 132, and a reinforcement wall 133 separates the first and the second receiving cavities 131, 132 in the longitudinal direction for limiting a movement of the memory module 9 along the longitudinal direction. The second receiving cavity 132 is opened to exterior in the longitudinal direction so that the ejector 3 rotates conveniently, and has a pair of stop blocks 134 located on two opposited inner side walls of the second receiving cavity 132, and a pair of pivot holes 135 under the stop blocks 134, respectively.

The ejector 3 is retained in the second receiving cavity 132, and has a body portion 31, an ejecting portion 32 inwardly extending to the central slot 109 from a lower end of the body portion 31, a locking head 33 and an operating portion 34 oppositely extending from a top end of the body portion 31 in the longitudinal direction. The body portion 31 has an inner wall 311 for abutting against the reinforcement wall 133, an outer wall 312 opposited to the inner wall 311 in the longitudinal direction, a pair of locking protrusions 313 located at two outer lateral sides thereof for respectively engaging with the stop blocks 134, and a pair of spindles 314 located under the locking protrusions 313 and received into the pivot holes 135 of the housing 1.

The contacts 2 are divided into two rows and each has a retaining portion 21 retained in the corresponding terminal slots 111, an elastic contacting portion 22 extending into the central slot 109 from the retaining portion 21, and a soldering portion 23 extending beyond the housing 1 from the retaining portion 21 and adapted for being mounted onto the mother board.

The latching mechanisms 5 are made by plastic or metal materials. The mechanisms 5 are disposed as a U-shaped configuration and each has a limiting portion 51 extending along the longitudinal direction, two extending arms 52 extending downwardly from two transverse ends of the limiting portion 51 and a latching portion 53 extending downwardly from a bottom of the extending arm 52. A width of the latching portion 53 along the longitudinal direction is as same as that of the positioning block 12. The limiting portion 51 has a retaining slot 511 depressed upwardly from a bottom surface thereof. A top of the memory module 9 is received in the retaining slot 511, so that the memory module 9 is prevented from moving up to down. The extending arm 52 and the latching portion 53 are located in a same vertical plane, the latching portion 53 is thinner than the extending arm 52 and the latching portion 53 has a nose portion 531 extending from a bottom thereof The nose portion 531, the latching portion 53 and the extending arm 52 define and surround a recess 54. The nose portion 531 has a second guiding slot 5311 depressing downwardly from a top surface thereof, which is also a bottom surface of the recess 54. The second guiding slot 5311 passes through the nose portion 531 along the longitudinal direction and does not pass inwardly therethrough to form a second flange 5312 extending upwardly from the nose portion 531 and adjacent to the second guiding slot 5311. The second guiding slot 5311 is located between the latching portion 53 and the second flange 5312.

When the memory module 9 is inserted into the central slot 109. At first, the ejector 3 rotates inwardly to latch the memory module 9. Then, the latching mechanism 5 is assembled into the housing 1 from top to bottom. The housing 1 is clamped by the latching portions 53 of the latching mechanism 5. The top of the memory module 9 is received in the retaining slot 511 of the limiting portion 51 to prevent the memory module 9 from swinging along the transverse direction and the pressed portion 51 presses the memory module 9 downwardly at the same time to prevent the memory module from moving upwardly. Finally, the latching mechanism 5 is moved along the longitudinal direction until the positioning block 12 received in the recess 54 completely. The first flange 122 is received in the second guiding slot 5311 and the second flange 5312 is received in the first guiding slot 121. The first and second flanges 122, 5312 latch with each other along the transverse direction to prevent the latching portions 53 from stretching outwardly and leaving the housing 1. The latching portion 53 upwardly abuts against the positioning block 12 to prevent the latching mechanism 5 from moving upwardly. The extending arm 52 extends inwardly beyond the side wall 103 of the housing 1 and a bottom of the latching portion 53 is higher than the mounting face 102.

When the memory module 9 is ejected from the card edge connector 100. At first, the latching mechanism 5 is moved along the longitudinal direction then upwardly to remove the latching mechanism 5 from the housing 1. Then, the ejector 3 rotates outwardly. The ejecting portion 33 of the ejector 3 ejects the memory module 9 out of the card edge connector 100.

The card edge connector 100 includes a pair of the positioning block 12 located in the left and right sides of the side walls 103 of the housing 1 and a pair of the latching mechanisms 5 latching with the positioning block 12. The latching mechanisms 5 are located symmetrically and closed to the ejectors 3. The latching mechanisms 5 can prevent the memory module 9 from moving upwardly, thereby the memory module 9 could be stably connected with the card edge connector 100. Understandably, if necessary, the end of the recess may be equipped with a stopper to restrain the movement of the latching mechanism relative to the positioning block 12 along the longitudinal direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising: an elongated housing extending along a longitudinal direction thereof and having a pair of opposed side walls and a central slot between the side walls for receiving a memory module; a plurality of contacts retained in side walls of the housing; and at least a latching mechanism assembled to the side walls and having a limiting portion over a top of the memory module to limit the memory module;

wherein the latching mechanism has a latching portion latching with the side walls;

wherein each of the side walls has at least one positioning block, the two opposite latching portions are latching with the positioning blocks of side walls, the latching mechanism is disposed as a U-shaped configuration and includes the limiting portion and two extending arms extending downwardly from two ends of the limiting portion, the latching portion extends downwardly from a bottom of the extending arm and has a nose portion extending inwardly but does not extend beyond an inside face of the extending arm, a recess is surround by the nose portion, the latching portion and the extending arm, the positioning block is received in the recess;

wherein the positioning blocks each have a first guiding slot depressing upwardly from a bottom thereof, the first guiding slot passes through the positioning block along the longitudinal direction but does not passes through an outside face of the positioning block to form a first flange which is adjacent to the first guiding slot; and wherein the nose portion has a second guiding slot depressing downwardly from a top thereof, the second guiding slot passes through the nose portion along the longitudinal direction but does not pass through an inside face of the nose portion to from a second flange adjacent to the second guiding slot, the first flange is received and fitted in the first guiding slot and the second flange is received and fitted in the second guiding slot.

2. The card edge connector as claimed in claim 1, wherein the limiting portion has a retaining slot depressing upwardly therefrom for receiving a top of the memory module to prevent the memory module from swinging.

3. The card edge connector as claimed in claim 1, wherein the housing has a mating face and a mounting face for mounting on a mother printed circuit board, a top of the positioning block is at a same height as that of the mating face, a bottom of the positioning block is higher than the mounting face, a bottom of the extending arm is located over the mating face of the housing.

4. The card edge connector as claimed in claim 1, wherein the latching mechanism is assembled downwardly to the housing and then slides along the longitudinal direction to latch with the positioning block.

5. A card edge connector assembly comprising:

a memory module;

an elongated housing extending along a longitudinal direction thereof and having a pair of opposed side walls, a central slot between the side walls for receiving the memory module and two tower portions extending upwardly from two sides of the housing, the tower portions each having a first receiving cavity to receive a side edge of the memory module to position the memory module;

a plurality of contacts retained in the housing; and at least one latching mechanism straddling the central slot and be fastened to the side walls of the housing, the latching mechanism limiting the memory module received in the central slot to move upwardly;

wherein the side walls have at least two positioning blocks, the latching mechanism has two opposite latching portions latching with corresponding positioning blocks of the housing;

wherein the latching mechanism is disposed as a U-shaped configuration and includes a limiting portion and two extending arms extending downwardly from two sides of the limiting portion, the latching portion extend downwardly from the latching arm and has a nose portion extending inwardly thereof but does not extend beyond an inside face of the extending arm, a recess is formed by the nose portion, the latching portion and the extending arm, the positioning block is received in the recess;

wherein the positioning blocks each have a first guiding slot depressing upwardly from a bottom thereof, the first guiding slot passes through the positioning block along the longitudinal direction but does not pass through an outside face of the positioning block to form a first flange adjacent to the first guiding slot; and wherein the nose portion has a second guiding slot depressing downwardly from a top thereof, the second guiding slot passes through the nose portion along the longitudinal direction but does not pass through an inside face of the nose portion to from a second flange adjacent to the second guiding slot, the first flange is received and fitted in the first guiding slot and the second flange is received and fitted in the second guiding slot.

6. The electrical connector assembly as claimed in claim 5, wherein the latching mechanism firstly assembled downwardly to the housing and then slides along the longitudinal direction to latch with the positioning block, the limiting portion has a retaining slot depressing upwardly therefrom for receiving a top of the memory module to prevent the memory module from swinging.

7. An electrical connector assembly for locking therein a memory module having a pair of notches on two opposite end edges, comprising:

an elongated insulative housing defining a slot along a lengthwise direction between a pair of opposite side walls;

a plurality of contacts disposed beside the slot;

a pair of retention devices located at two opposite ends of the housing along said lengthwise direction, each of said retention devices defining a locking head; and at least one latching mechanism attached upon at least one of said pair of side walls;

wherein the latch mechanism defines a top portion for grasping a top edge of the memory module so as to provide additional retention to the memory module other than said pair of retention devices;

wherein the latching mechanism defines a U-shaped structure assembled to both said pair of side walls;

wherein the at least one of the pair of side walls defines a positioning block on an exterior surface, the positioning block having a first flange and a first guiding slot, and the latch mechanism defines a nose portion having a second guiding slot for grasping the positioning block to prevent movement of the latching mechanism relative to the housing in a vertical direction perpendicular to said lengthwise direction, regardless of whether the memory module is received in the housing or not;

wherein said latching mechanism further includes a second flange portion outwardly abutting against the first flange of the positioning block so as to prevent the latching mechanism from outward moving relative to the housing in a transverse direction perpendicular to both said lengthwise direction and said vertical direction; and wherein the latching mechanism defines a retaining slot for retaining a to edge of the memory module.

8. The electrical connector as claimed in claim 7, wherein the latching mechanism and the positioning block are configured to only allow the latching mechanism to be assembled to the positioning block initially downwardly along the vertical direction and successively along the lengthwise direction.

* * * * *